United States Patent [19]

Nimmey et al.

[11] Patent Number: 4,964,538

[45] Date of Patent: Oct. 23, 1990

[54] PACKAGE FOR FLOWABLE MATERIAL

[75] Inventors: Alan Nimmey, Sale; Harry Hayes, Warrington, both of England

[73] Assignee: Colgate-Palmolive Company, Piscataway, N.J.

[21] Appl. No.: 473,898

[22] Filed: Feb. 2, 1990

Related U.S. Application Data

[63] Continuation of Ser. No. 221,668, Jul. 20, 1988, abandoned.

[51] Int. Cl.[5] ..... B65D 35/06

[52] U.S. Cl. ..... 222/92

[58] Field of Search ..... 222/92, 107, 206, 212, 222/215, 153, 562; 215/329

[56] References Cited

U.S. PATENT DOCUMENTS

| | | | |
|---|---|---|---|
| 624,549 | 5/1899 | Scales | 222/92 |
| 675,372 | 6/1901 | Brooks | 222/92 |
| 2,829,802 | 4/1958 | Paull | 222/92 |
| 3,529,751 | 9/1970 | Marchant | 222/92 |
| 4,526,297 | 7/1985 | Grimsley | 222/107 |

FOREIGN PATENT DOCUMENTS

| | | | |
|---|---|---|---|
| 433093 | 8/1935 | United Kingdom | 222/92 |
| 1116910 | 6/1988 | United Kingdom | 222/215 |

*Primary Examiner*—Michael S. Huppert

*Attorney, Agent, or Firm*—Richard J. Ancel; Robert C. Sullivan; Murray M. Grill

[57] ABSTRACT

A package for a flowable material comprising, an elongated collapsible tube defining a chamber to receive the material, the tube having a tapered shoulder, with the shoulder having a generally central opening. The package has a separate insert comprising a hollow tubular section received in the opening, with the tubular section having an outer end portion located outside of the shoulder, and an inner end portion extending into the chamber a sufficient distance to prevent extrusion of the material in the region of the shoulder through the tubular section, and a device for sealingly engaging the shoulder around the opening.

11 Claims, 1 Drawing Sheet

FIG. 1
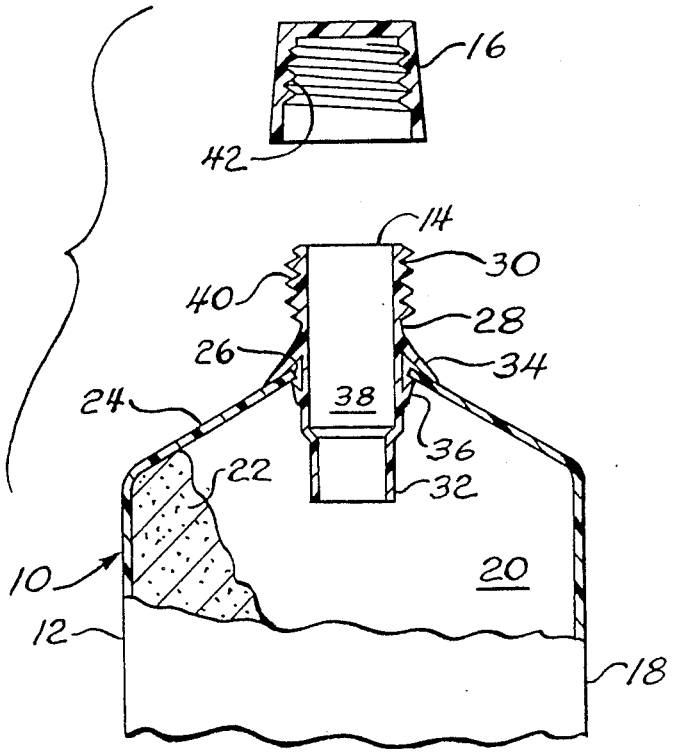
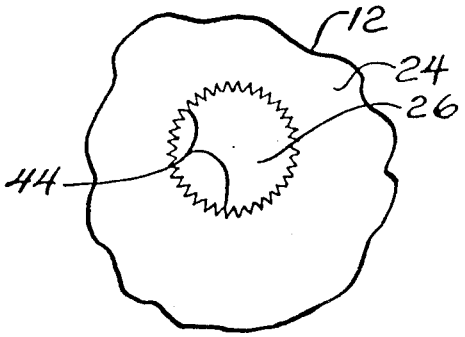
FIG. 2

PACKAGE FOR FLOWABLE MATERIAL

This is a continuation of application Ser. No. 221,668filed July 20, 1988, now abandoned.

BACKGROUND OF THE INVENTION

The present invention relates to a package for a flowable material which is susceptible to flavor loss.

The use of collapsible tubes for a flowable material, such as dental cream, is known. The tubes normally define a chamber, have a tapered shoulder, and have a neck extending from the shoulder. The tubes are normally constructed from a laminate, such as polyethylene, aluminum foil, paper, and polyethylene. Although the tubes operate satisfactorily in dispensing the material, it has been found that the material is subject to flavor loss in the region of the shoulder.

The normal solution to this problem has been to use plastics in the tube with enhanced flavor barrier properties. However, these materials are generally expensive, particularly since separate moldings are necessary, and bonding is required between these barrier materials and the normal shoulder of the tube.

SUMMARY OF THE INVENTION

A principal feature of the present invention is the provision of an improved package for a flowable material which is susceptible to flavor loss.

The package of the present invention comprises, an elongated collapsible tube defining a chamber to receive the material, with the tube having a tapered shoulder, and with the shoulder having a generally central opening. The package has a separate insert comprising a hollow tubular section received in the opening, with the tubular section having an outer end portion located outside of the shoulder, and an inner end portion extending into the chamber.

A feature of the present invention is that the inner end portion extends into the chamber a sufficient distance to prevent extrusion of the material in the region of the shoulder which is subject to flavor loss through the tubular section.

Yet another feature of the invention is the provision of means for sealingly engaging the shoulder by the tubular section around the opening in order to close the opening.

Still another feature of the invention is that the insert may be utilized with any type of material for the tube.

A further feature of the invention is the provision of means for preventing the insert from turning in the opening to prevent movement of the tubular section while securing or removing a threaded cap onto or from the tubular section.

Further features will become more fully apparent in the following description of the embodiments of this invention and from the appended claims.

DESCRIPTION OF THE DRAWINGS

In the drawings:

FIG. 1 is a fragmentary sectional view of a package of the present invention; and FIG. 2 is a fragmentary plan view of a portion of a shoulder for a tube of the package of FIG. 1 taken around a central opening of the shoulder.

DESCRIPTION OF THE PREFERRED EMBODIMENTS

Referring now to FIG. 1, there is shown a package generally designated 10 comprising a collapsible tube 12, an insert 14, and a cap 16. The tube 12 has a squeezable or collapsible main body portion 18 defining a chamber 20 to retain the flowable material 22 which is susceptible to flavor loss, such as a dental cream. The tube 12 has a tapered shoulder 24, with the shoulder 24 having a generally central opening 26. The tube 12 may be constructed of any suitable material, such as aluminum, or a laminate comprising polyethylene, aluminum foil, paper, and polyethylene.

The insert 14 comprises an elongated tubular section 28 which is received in the opening 26, and which is snap-fit into the opening 26 of the shoulder 24. The tubular section 28 has an outer end portion 30 located outside of the shoulder 24, and an inner portion 32 extending into the chamber 20 to a location past the shoulder 24. The tubular section 28 has an outer annular outwardly directed tapered blade 34 sealingly engaging against an outer surface of the shoulder 24 around the opening 26, and an inner annular outwardly directed tapered blade 36 sealingly engaging against an inner surface of the shoulder 24 around the opening 26. Thus, once the tubular section 28 is snap-fit into the shoulder 24, the flanges 34 and 36 prevent the passage of the material 22 between the tubular section 28 and shoulder 24 through the opening 26.

The tubular section 28 has a lumen 38 extending through the tubular section 28 in order to permit passage of the material 22 through the tubular section 28 to the outside of the package 10. The outer end portion 30 of the tubular section 28 has outer threads 40, as shown. The cap 16 has inner threads 42 which cooperate with the threads 40 of the tubular section 28 in order to releasably secure the cap 16 onto the insert 14 and close the lumen 38. As shown in FIG. 2, the shoulder has a plurality of serrations 44 disposed around the opening 26 which frictionally engage against the tubular section 28 intermediate the blades 34 and 36 in order to prevent turning of the tubular section 28 in the opening 26 while securing the cap 16 to the tubular section 28 and removing the cap 16 from the tubular section 28. The tubular section 28 may be constructed from a suitable plastic material, such as high density polypropylene or nylon, which does not cause flavor loss in the material 22. The outer surface of the tubular section 28 in contact with the shoulder may also have a serrated surface or matted finish to assist in the frictional retention during rotation. The cap, 16, may also be of the captive or flip-top type.

In accordance with the present invention, the tubular section 28 may be secured to a tube 12 of any type material, as desired. In the event that a material is utilized in the tube 12 which causes flavor loss in the region of the shoulder 24 of the tube 12, the inner end portion 32 of the tubular section 28 prevents extrusion of this material adjacent the shoulder 24 through the tubular section 28 and outside of the package 10, thus eliminating the dispensing of material 22 which is subject to flavor loss.

The foregoing detailed description is given for clearness of understanding only, and no unnecessary limitations should be understood therefrom, as modifications will be obvious to those skilled in the art.

We claim:

1. A package for a flowable material, comprising:

an elongated collapsible tube having a wall defining a chamber to receive the material, said tube having a tapered shoulder of one-piece construction with said wall and defining a forward portion of said chamber substantially across the chamber such that the material contacts said shoulder, with said shoulder being directed forwardly of said wall and having a generally central opening; and a separate insert comprising a hollow tubular section received in the opening, said tubular section having an outer end portion located outside of the shoulder, and an inner end portion having substantially the same dimensions as the outer end portion and extending into the chamber to a location past the shoulder a sufficient distance to prevent extrusion of the material in the region of the shoulder through the tubular section, said shoulder and insert defining at their juncture an inwardly tapered and narrowing space of said chamber to direct said material forwardly along the shoulder and capture the material intermediate the shoulder and insert, and means for sealingly engaging the shoulder around the opening.

2. The package of claim 1 wherein the tube comprises a laminate material.

3. The package of claim 1 wherein the tube comprises aluminum.

4. The package of claim 1 wherein the engaging means comprises an outer annular outwardly directed blade of the tubular section sealingly engaging against an outer surface of the shoulder around the opening, and an inner annular outwardly directed blade of the tubular section sealingly engaging against an inner surface of the shoulder around the opening.

5. The package of claim 1 wherein the insert comprises polypropylene.

6. The package of claim 1 wherein the insert comprises nylon.

7. The package of claim 1 wherein the shoulder opening has a plurality of serrations frictionally engaging against the tubular section to prevent turning of the tubular section in the opening.

8. The package of claim 1 including means for preventing turning of the tubular section in the opening.

9. The package of claim 8 wherein the outer end portion of the tubular section has threads on an outer surface thereof.

10. The package of claim 9 including a cap having inner threads which cooperate with the threads of the tubular section to secure the cap onto the tubular section and close the tubular section.

11. The package of claim 1 wherein the outer end portion of the tubular section has the facility for the fitment of a captive or flip-top cap.

* * * * *